United States Patent [19]

Warncke

[11] Patent Number: 4,470,413

[45] Date of Patent: Sep. 11, 1984

[54] PROTECTIVE BREATHING APPARATUS INCLUDING A MASK AND MOUTHPIECE

[75] Inventor: Ernst Warncke, Lübeck, Fed. Rep. of Germany

[73] Assignee: Drägerwerk Aktiengesellschaft, Fed. Rep. of Germany

[21] Appl. No.: 406,174

[22] Filed: Aug. 9, 1982

[30] Foreign Application Priority Data

Jan. 29, 1982 [DE] Fed. Rep. of Germany ..... 3202870

[51] Int. Cl.[3] ..... A62B 7/00

[52] U.S. Cl. ..... 128/201.18; 128/206.24; 128/206.29

[58] Field of Search ..... 128/206.29, 201.20, 128/205.25, 206.26, 201.23, 201.24, 201.18, 206.12, 206.24, 206.15, 207.14–207.16, 201.18, 206.19, 202.28, 206.21, 207.15

[56] References Cited

U.S. PATENT DOCUMENTS

| | | | |
|---|---|---|---|
| 1,445,010 | 2/1923 | Feinberg | 128/201.28 |
| 3,809,079 | 5/1974 | Buttaravoli | 128/206.24 |
| 4,090,511 | 5/1978 | Gray | 128/201.18 |
| 4,319,567 | 3/1982 | Magidson | 128/206.19 |
| 4,334,534 | 6/1982 | Ozaki | 128/207.15 |

FOREIGN PATENT DOCUMENTS

| | | | |
|---|---|---|---|
| 738137 | 8/1943 | Fed. Rep. of Germany | 128/206.29 |
| 1113065 | 8/1961 | Fed. Rep. of Germany | 128/206.29 |

*Primary Examiner*—Henry J. Recla
*Assistant Examiner*—Kann M. Reichle
*Attorney, Agent, or Firm*—McGlew and Tuttle

[57] ABSTRACT

A protective breathing apparatus comprises a breathing gas supply tube fitted into a protective face mask which has an opening to which the tube extends and which has a peripheral sealing lip adapted to seal the mask around the user's face. The mouthpiece is attached to the inner end of the tube into the mask and it is engageable by the user's mouth through association with the mouth for breathing. The mask advantageously includes a thickened area on each side of the person's nose to constrict the nose so that breathing is through the mouth, and the mouthpiece advantageously includes bite nipples which are engageable by the mouth in order to hold the tube in the vicinity of the mouth for breathing. Alternatively, the mouthpiece comprises an end having a plurality of serrations along it which fits into the mouth.

5 Claims, 5 Drawing Figures

PROTECTIVE BREATHING APPARATUS INCLUDING A MASK AND MOUTHPIECE

FIELD AND BACKGROUND OF THE INVENTION

This invention relates in general to breathing apparatus and in particular to a new and useful protective breathing apparatus which comprises a breathing gas supply tube which is connected into a face mask which terminates in the interior of the face mask in a mouthpiece which is engageable with the person's mouth.

Full face masks are the conventional breathing connections. However, the strapping of such mask requires some practice to ensure the correct fit. Further known are half face masks. Since they require a particular contour of the sealing rim, they are very difficult to design and also to put on. They may best be connected for breathing through a mouthpiece. For this purpose, however, it is necessary to close the nose.

A prior art mouthpiece for breathing apparatus comprises an oxygen supply tube having an elliptic cross-section and a mouthpiece sleeve preferably of rubber, is engaged over the tube. The mouthpiece sleeve is formed with two flanges of which, during use, the inner one applies to the backside of the user's front teeth, while the outer one remains in front of the user's lips. Two resilient holders are secured to the mouthpiece sleeve in front of the outer flange, each carrying a plug on its end. During the use of the mouthpiece, these plugs close the nostrils. Since the shape of the user's faces vary, no safe seal can be obtained and noxious substances may penetrate from the ambience directly into the nose and the respiratory ducts. Also the nose plugs are very inconvenient for the user. (German Pat. No. 6669841).

Another prior art mouthpiece for protective breathing apparatus comprises a nose clamp which is displaceable. In addition to parts which can be introduced into the mouth, the mouthpiece carries a mouth flange covering the entire mouth region from the outside and bearing against the head strapping. Outside the mouth flange, the mouthpiece is provided with perpendicular, parallel guide surfaces. A U-shaped holding band is passed from above through two guide holes in such a manner that its ends apply against the guide surfaces and are clamped in the adjusted position. A nose clamping spring is pivotally mounted on the back of the holding band through a double lug, and the holding band is adjustable vertically. On its end, the nose clamping spring carries rubber discs. Due to the clamping, the nose clamp remains in the selected position of use, also when not in use so that the repeated use is facilitated. However, the attachment of the nose clamp requires additional handling and the time needed therefor is frequently not available in emergency cases. Moreover, during an extended use, the pressure of the nose clamp on the nose is inconvenient (German Pat. No. 10708055).

SUMMARY OF THE INVENTION

The invention is directed to a breathing apparatus connection comprising a mouthpiece constructed to ensure that, in situations of imminent danger, a tight connection can be effected quickly and reliably, without the need of particular handling.

In accordance with the invention, a breathing gas supply tube is connected centrally into a protective face mask which has a peripheral sealing lip adapted to seal around the user's face. The tube carries a mouthpiece at its inner end with bite nipples which may be engaged by the user's mouth to hold the tube in association with the mouth for breathing. A mask advantageously includes a thickened area to constrict the nose so that breathing is through the mouth.

What is substantial in the invention is the combination of a mouthpiece with a half face mask. In case of danger, the mouthpiece is introduced into the mouth. This makes the mask positively and tightly applied against the mouth and nose region of the face. This simple manipulation once accomplished, the user has his both hands instantly free again. During an escape, for example in complete darkness in a mine, this may be life saving.

The half face mask is designed not only to cover the nose and the region around the mouth, but also to set the nose size under an additional slight closing pressure which is sufficient to ensure a breathing through the mouthpiece.

The design with an elastic diaphragm between the mask and the breathing mask supply tube, or with a serrated mouthpiece, ensure a tight connection with the same simple fit even if the face and nose shapes are difficult. With a serrated mouthpiece, the mouthpiece can be retained in tthe mouth always as deep as necessary to make the nose closing pressure effective.

Accordingly, it is an object of the invention to provide a protective breathing apparatus which includes a face mask connected to a breathing supply tube which extends through the center of the mask and which carries a mouthpiece at its interior which may be engaged by the person's mouth and where the mask provides a peripheral seal around the face of the wearer, and engages around the wearer's nose and advantageously closes off the nasal passages.

A further object of the invention is to provide a protective breathing apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 4:
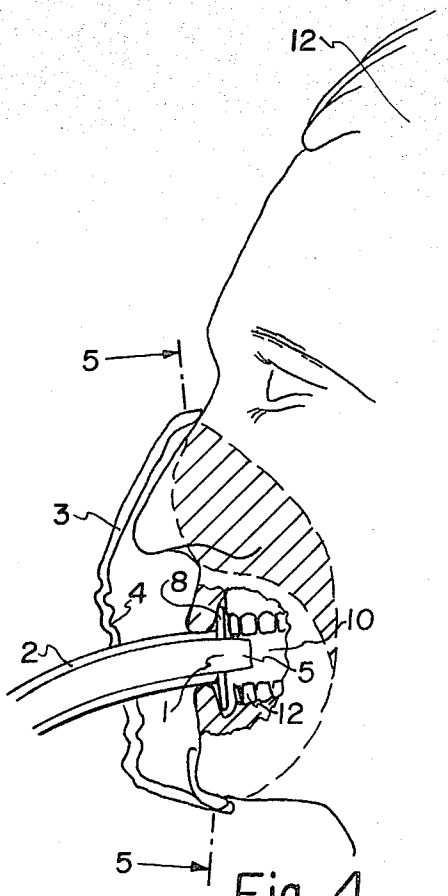
FIG. 4 is a partial sectional view of the mask shown in FIG. 1 applied over a person's face.

Referring to the drawings in particular the invention embodied therein comprises a protective breathing apparatus which includes a breathing gas supply tube 2 which is adapted to be connected at its outer end to a source of breathing gas and which extends to a central opening of a protective mask 3 and terminates on the interior of the mask in a mouthpiece 1 which may be positioned in association with the mouth 10 of a user 12. In one embodiment the mouthpiece 1 is provided with an engagement ring or lip 8 which may be manipulated by the person's mouth to hold and seal the tube with a person's teeth 12 in his mouth for breathing through the mouth (FIG.4). In this embodiment the nose 14 is advantageously constricted, or the nasal passages cut off, so that breathing will not be through the nose, by providing thickened padding or sealing portion 7 at the interior of the mask on each side of the nose which closes off the nose.

The breathing connection comprises the mouthpiece 1 formed on the breathing air supply tube 2. A cover 3 in the shape of a face mask is engaged over the tube 2. In its portion connected to and surrounding tube 2, cover 3 is made of a very elastic annular diaphragm 4.

Mouthpiece 1 comprises bite nipples 5, in addition to the sealing lip 8 and cover 3 is formed with a peripheral sealing lip 6 including thickened portions 7 on each side of a nose cavity to be applied against the nose slides and restricts or cuts off breathing through the nose.

Upon taking mouthpiece 1 into the mouth and gripping nipples 5 with the teeth, cover 3 adapts by its diaphragm portion 4 to the face and is correspondingly shifted back. Sealing rim or lip 6 applies against the face under tension and the thicker portions 7 come to apply to the nose side and seal off the nasal passages to a large extent, so that nose breathing is thereby substantially eliminated. The configuration closes around the nose and over the mouth so that strapping on of the mask becomes less important.

Figure 5:
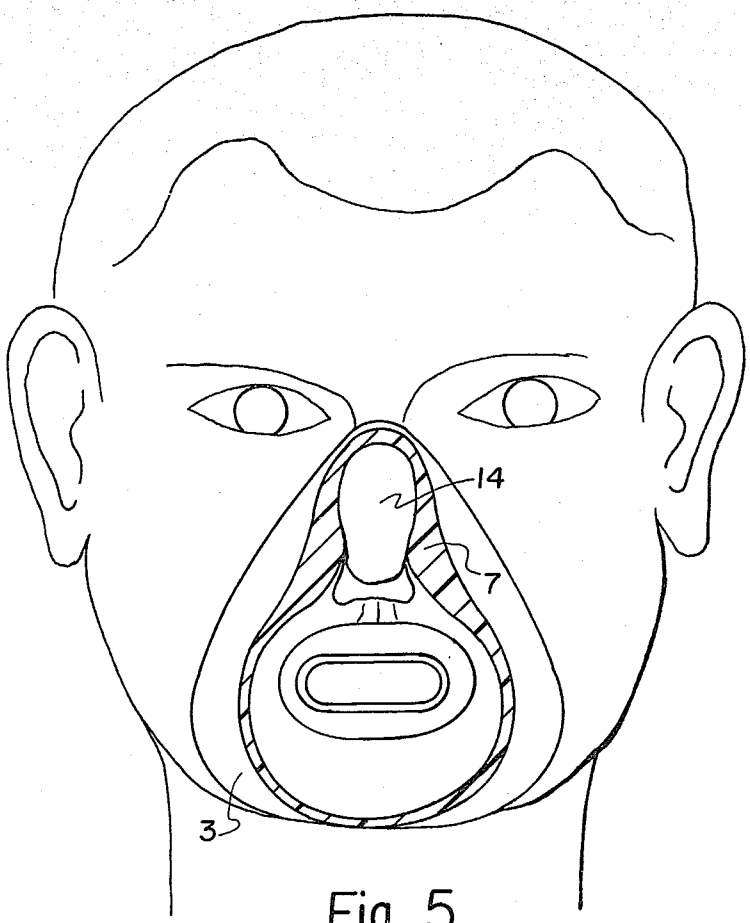
FIG. 5 is a section taken along the line 5—5 of FIG. 4.

The inventive mask is an improvement over conventional half face masks inasmuch as it provides a clamping action on a person's nose to ensure that breathing will be through the mouth and the clamping engagement of the nose in conjunction with use of a mouthpiece enusures that the mask will fit to the person easily and readily and without requiring additional straps. Sealing of the nose is desirable in order to ensure that breathing takes place through the person's mouth. When the mask is applied as shown in FIG. 5, it is indicated how the nostrils become closed and as shown in FIG. 4, the mouthpiece permits the holdling of the mask to the person's face and the arrangement ensures the deformation of the mask so that the cover is stretched and pulled toward the face.

Figure 1:
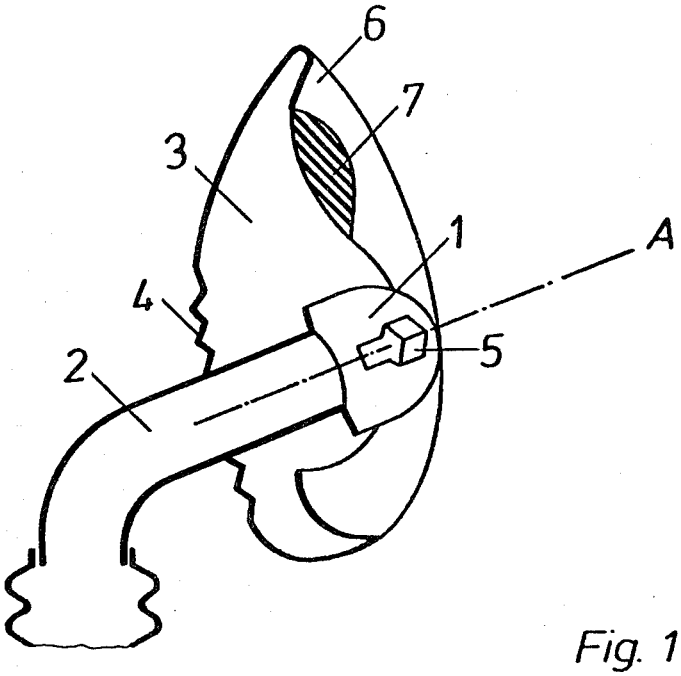
FIG. 1 is a schematic perspective view of a protective breating apparatus constructed in accordance with the invention.
Figure 2:
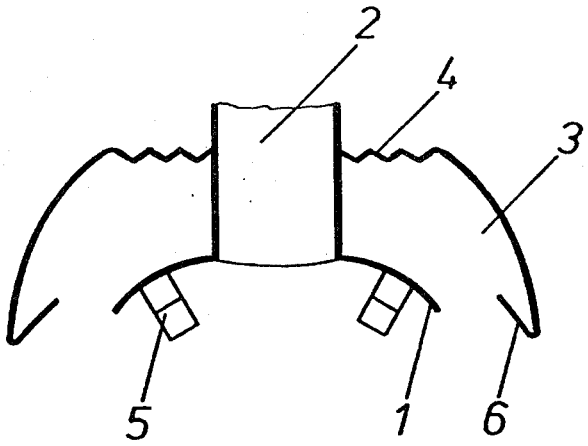
FIG. 2 is a schematic sectional view through the middle of the mask showing the mouthpiece of one embodiment of the invention.
Figure 3:
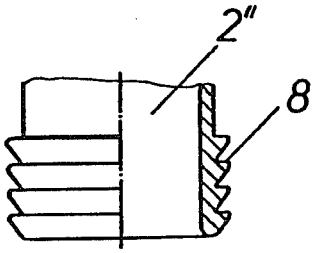
FIG. 3 is a partial elevational and sectional view of the mouthpiece according to another embodiment of the invention.

In the embodiment of FIG. 3, mouthpiece 1 on breathing gas supply tube 2'' is cerrated, i.e. serrated, i.e. its axial cross section has a saw-toothed-like contour 8''. With this design, an elastic annular diaphragm portion 4 of cover 3 may be omitted. While putting on the mask, tube 2'' is introduced into the mouth and held fast by the teeth until cover 3 firmly applies especially against the nose region.

Bite projections 5 or contour 8'' may be thought of as bite means for the wearer.

While specific embodiments of the invention have been shown and decribed in detail to illustrate the application of the principles of the invention, it will be understood that the invention may be embodied otherwise without departing from such principles.

What is claimed is:

1. A protective breathing apparatus, comprising a breathing gas supply tube, a protective face mask having a mask body including an opening through which said tube extends, the portion of said mask body surrounding said opening being an elastic annular diaphragm secured about said tube, a peripheral sealing lip and nose engaging portion shaped to engage tightly over and on each side of a user's nose and to be clamped thereto and to encircle a user's mouth to seal around a user's nose and mouth, a mouthpiece connected to the end of said tube which extends through said mask body engageable with a user's mouth and cooperating with said nose engaging portion to hold the tube in association with a user's mouth, and bite means connected to said mouthpiece and engageable by a user's mouth to center said mask body over a user's mouth and nose.

2. A protective breathing apparatus according to claim 1, wherein said nose engaging portion comprises padding on the interior of said mask body adapted to be positioned on each side of a user's nose to close off the nose so that breathing is through the mouth.

3. A protective breathing apparatus according to claim 2, wherein said bite means comprises a bite nipple engageable with a user's mouth.

4. A protective breathing apparatus, comprising:

a protective face mask having a mask body shaped to extend over a chin, mouth and nose area of a wearer;

a sealing lip connected around a periphery of said mask body for engagement with a wearer's face for establishing a gas seal between a wearer's face and said mask body;

a breathing gas supply tube, said mask body including an opening at a location corresponding to a position of a wearer's mouth when said mask body is to be worn by a wearer through which the breathing tube extends, and the portion of the mask body surrounding said opening being an elastic annular diaphragm secured about said tube;

a mouthpiece lip connected to an end of said tube in said mask body, at a location spaced from said mask body, said mouthpiece lip adapted to be positioned between a wearer's lips and wearer's teeth; and a pair of bite projections connected to said mouthpiece lip at spaced locations thereon and on opposite sides of said tube for engagement by a wearer's teeth.

5. A breathing apparatus according to claim 4, including padding connected to the interior of said mask body adapted to be positioned at a location in said mask body for receiving a wearer's nose to close off a wearer's nose to permit breathing only through a wearer's mouth.

* * * * *